US012157607B1

(12) United States Patent
Stephan

(10) Patent No.: US 12,157,607 B1
(45) Date of Patent: Dec. 3, 2024

(54) DRIP PREVENTION DEVICE AND METHOD

(71) Applicant: Alicia Stephan, Renton, WA (US)

(72) Inventor: Alicia Stephan, Renton, WA (US)

( * ) Notice: Subject to any disclaimer, the term of this patent is extended or adjusted under 35 U.S.C. 154(b) by 0 days.

(21) Appl. No.: 18/533,927

(22) Filed: Dec. 8, 2023

Related U.S. Application Data

(60) Provisional application No. 63/433,105, filed on Dec. 16, 2022.

(51) Int. Cl.
*B65D 23/06* (2006.01)

(52) U.S. Cl.
CPC ..... *B65D 23/065* (2013.01)

(58) Field of Classification Search
CPC ..... B65D 23/065; B65D 23/06; B65D 47/40; B65D 5/6617; B65D 47/205
See application file for complete search history.

(56) References Cited

U.S. PATENT DOCUMENTS

| | | | | |
|---|---|---|---|---|
| 447,335 | A | 3/1891 | Day, Jr. | |
| 571,088 | A | 11/1896 | Hamilton | |
| 3,063,590 | A * | 11/1962 | Hopkins | B65D 23/065 D19/1 |
| 5,116,687 | A * | 5/1992 | Asano | D04D 7/105 223/46 |
| 5,188,877 | A * | 2/1993 | Magaro | B65D 81/3886 428/80 |
| 5,240,750 | A * | 8/1993 | Cheng | D04D 7/10 223/46 |
| 5,545,486 | A * | 8/1996 | Asano | D04D 7/10 223/46 |
| 5,651,481 | A | 7/1997 | Jensen | |
| 5,979,718 | A | 11/1999 | Jinathan | |
| 6,073,816 | A | 6/2000 | Granberg | |
| 6,228,459 | B1 | 5/2001 | Bujalski | |
| 6,609,639 | B1 | 8/2003 | Genthon | |
| 7,111,747 | B2 | 9/2006 | Paikin et al. | |
| 7,192,632 | B2 * | 3/2007 | Heldibridle | B32B 5/24 428/80 |
| 9,624,001 | B1 | 4/2017 | Hill | |
| D828,116 | S | 9/2018 | Hill | |
| 2005/0199579 | A1 | 9/2005 | Novak | |

(Continued)

FOREIGN PATENT DOCUMENTS

| | | | |
|---|---|---|---|
| DE | 202020101088 | U1 | 3/2020 |
| GB | 2427394 | A | 12/2006 |
| WO | 2014199060 | A1 | 12/2014 |

OTHER PUBLICATIONS

How to Fold a Wine Bottle Drip Guard from a Paper Towel, youtube.com. https://www.youtube.com/watch?v=TdB0alzi3KM [Date accessed: Aug. 19, 2022].

(Continued)

*Primary Examiner* — Kareen K Thomas
(74) *Attorney, Agent, or Firm* — Bold IP PLLC

(57) ABSTRACT

A drip prevention device comprises a strip of flexible and absorbent material extending from a first free end to a second free end. A first fastener is attached to the first free end and a second fastener is attached to the second free end. The strip is configured with sufficient length to be wrapped around a bottle and knotted to form a knot on one side of the bottle with the first and second fasteners fastened on an opposite side of the bottle, thereby securing the drip prevention device to the bottle.

5 Claims, 13 Drawing Sheets

(56) References Cited

U.S. PATENT DOCUMENTS

| | | | |
|---|---|---|---|
| 2008/0185360 | A1 | 8/2008 | Zak et al. |
| 2008/0314924 | A1 | 12/2008 | Marr et al. |
| 2009/0294398 | A1 | 12/2009 | Fornes |
| 2010/0243600 | A1 | 9/2010 | Summer et al. |
| 2011/0011487 | A1 | 1/2011 | Barnes |
| 2014/0014610 | A1 | 1/2014 | Steinberg |

OTHER PUBLICATIONS

Wine cuff Drop catcher. Etsy.com. https://www.etsy.com/uk/listing/614460674/wine-cuff-drop-catcher-wine-collar-scarf?click_key=7b842f734597d7dcf21d8ecce5748bb10d18e84a%3A614460674&click_sum=1463a323&ga_order=most_relevant&ga_search_type=all&ga_view_type=gallery&ga_search_query=wine+drip+collar&ref=listing_in_grid-1-4 [Date accessed: Aug. 19, 2022].

* cited by examiner

DRIP PREVENTION DEVICE AND METHOD

CROSS-REFERENCE TO RELATED APPLICATIONS

This application is a non-provisional application that claims the benefit of priority of U.S. provisional patent application No. 63/433,105, filed on Dec. 16, 2022, which is incorporated by reference in its entirety.

FIELD OF THE DISCLOSURE

This disclosure relates to a drip prevention device that may be secured to a bottle such as a wine bottle to prevent drips from running down the sides of the opened bottle, which may cause stains and diminish the presentation.

BACKGROUND

The following background should not be assumed to be prior art and may include information that describes one or more aspects of the subject invention.

When a wine bottle (or other liquid-containing bottle) is opened and wine is poured, drips may form near the opening (the "finish") of the bottle when the wine is poured. These drips may then run down the neck of the bottle, over the shoulder, and down the body of the bottle. In running down the body of the bottle, the drips may stain the label of the bottle and diminish the presentation of the wine. Ultimately, the drips may reach the surface on which the bottle is placed, potentially staining the surface or a tablecloth covering the surface.

Various attempts have been made to address this issue. Each time wine is poured, the finish area of the bottle may be wiped free of drops using a napkin or cloth, which may be cumbersome and subject to the memory of the pourer to perform the task. Alternatively, a cloth or napkin may be loosely wrapped around the bottle, which is generally unsightly, may not catch all drips, and may fall off the bottle. Another option is to place a napkin or cloth between the bottle and the surface on which the bottle is placed. This option is also generally unsightly, offers no protection to the label, and comes with the risk that drops may soak through the napkin or cloth and still damage the underlying surface.

SUMMARY

The following summary relates to one or more aspects or embodiments of this disclosure. It is not an extensive overview relating to all contemplated aspects or embodiments, and should not be regarded as identifying key or critical elements of, or delineating the scope associated with, any particular aspect or embodiment. The following summary has the sole purpose of presenting certain concepts of this disclosure in a simplified form to precede the detailed description that follows.

A novel device and method is provided that addresses the issue of drip prevention in a manner that is not cumbersome to the pourer and that does not diminish the attractiveness of the presentation. A drip prevention device, also referred to herein as a "wine knot", is secured around a bottle to catch drips and prevent stains. The drip prevention device is of sufficient length to be wrapped and knotted around the neck of a bottle with the free ends further secured around the bottle by fasteners. By forming a knot in addition to securing the material with the fasteners, the drip absorbing area of the material against the bottle is increased, and drips are stopped and absorbed and are not able to continue down the bottle.

Some aspects of this disclosure are directed to a drip prevention device comprising a strip of flexible and absorbent material extending from a first free end to a second free end. A first fastener is attached to the first free end and a second fastener is attached to the second free end. The strip is configured with sufficient length to be wrapped around a bottle and knotted to form a knot on one side of the bottle with the first and second fasteners fastened on an opposite side of the bottle, thereby securing the drip prevention device to the bottle.

In some implementations, a decorative piece is attached to one of the first and second free ends to at least partially conceal the drip prevention device when secured to the bottle.

In some implementations, the strip is configured with sufficient length to be wrapped around the neck of the bottle.

In some implementations, the flexible and absorbent material comprises cotton, linen, or denim.

In some implementations, the fasteners are hook-and-loop fasteners.

In some implementations, the strip is formed from a piece of material having a rectangular shape.

In some implementations, the piece of material is folded and sewn to form the strip.

In some implementations, the strip is formed by sewing side edges of the piece of material to form side hems; sewing top and bottom edges of the piece of material to form top and bottom hems; folding the piece of material in half lengthwise such that the side hems are aligned with each other; sewing the side hems together; and pulling the piece of material lengthwise through itself such that the piece of material is turned inside-out and the top, bottom, and side hems are obscured.

Other aspects of this disclosure are directed to a method for preventing drips from a bottle. The method comprises providing a strip of flexible and absorbent material with fasteners at each end; wrapping the strip around the bottle; knotting the strip to form a knot on one side of the bottle; and securing the fasteners on an opposite side of the bottle to increase a drip absorbing area of the strip that is in contact with the bottle.

Further aspects of this disclosure are directed to a method for forming a drip prevention device. The method comprises providing a piece of flexible and absorbent material; folding and sewing the piece of flexible and absorbent material to form a strip having a rectangular shape and extending from a first free end to a second free end; attaching a first fastener to the first free end; attaching a second fastener to the second free end; and forming the strip with a sufficient length to be wrapped around a bottle and knotted to form a knot on one side of the bottle with the first and second fasteners fastened on an opposite side of the bottle, thereby securing the drip prevention device to the bottle.

Various additional aspects of this disclosure are described below and depicted in the accompanying figures and will be further apparent based thereon.

BRIEF DESCRIPTION OF THE DRAWINGS

Various features and advantages of this disclosure will be apparent from the following description and accompanying drawings. The drawings are not necessarily to scale; emphasis instead is placed on illustrating the principles of this disclosure. In the drawings, like reference characters may refer to the same parts throughout the different views. The drawings depict only illustrative examples of this disclosure and are not limiting in scope.

DETAILED DESCRIPTION

The embodiments described herein do not limit the invention to the precise form disclosed, nor are they exhaustive. Rather, various embodiments are presented to provide a description for utilization by others skilled in the art.

This disclosure is drawn to a drip prevention device, referred to herein as a "wine knot", that is secured around the neck of a bottle such as a wine bottle to catch drips and prevent stains. An absorbent material, fabric, or cloth such as cotton, linen, or denim is formed into a strip or rectangle with a fastener attached to each end. The rectangular material is of sufficient length to be wrapped and knotted around the neck of the bottle with the free ends secured by the fasteners. By forming a knot in addition to securing the material with the fasteners, the drip absorbing area of the material against the bottle is increased, and drips are stopped and absorbed and are not able to continue down the bottle.

Figure 1A:
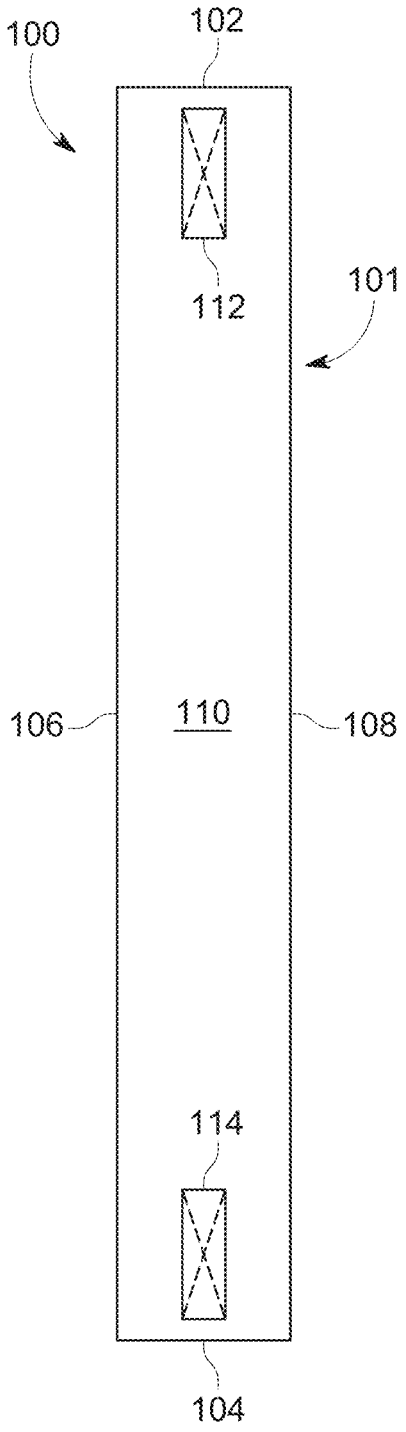
FIG. 1A is a block diagram of a first side of a drip prevention device, with fasteners attached thereto, in accordance with aspects of this disclosure.
Figure 1B:
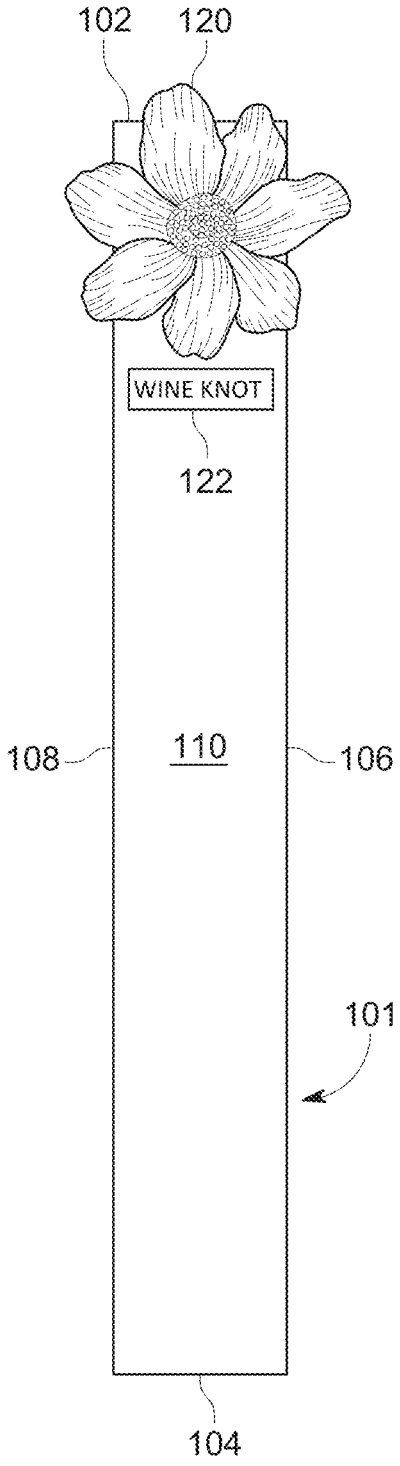
FIG. 1B is a block diagram of a second side of the drip prevention device of FIG. 1A, with a decorative piece attached thereto, in accordance with aspects of this disclosure.

FIGS. 1A-1B are block diagrams of first and second sides of a drip prevention device 100 in accordance with aspects of this disclosure. Drip prevention device 100 comprises a strip 101 of absorbent and flexible material, fabric, or cloth such as cotton, linen, denim, or any other suitable material for absorbing drips of wine or other liquids. In FIGS. 1A-1B, drip prevention device 100 is shown in an extended or elongated form before being secured to a bottle. In this regard, although this disclosure is presented primarily in the context of wine bottles and absorption of wine drips, it should be understood that drip prevention device 100 may be used in connection with bottles of other liquids besides wine and may be formed from materials suitable for absorption of such other liquids.

In one example, as can be seen in FIGS. 1A-1B, drip prevention device 100 takes the form of rectangular strip 101 of a flexible and absorbent material, fabric, or cloth extending lengthwise between free ends 102 and 104, and widthwise between sides 106 and 108. A middle body portion 110 of strip 101 is located between free ends 102 and 104. Although drip prevention device 100 is depicted as having a rectangular and extended configuration when not secured to a bottle, drip prevention device 100 may take other configurations and shapes as is suitable and appropriate. Free ends 102 and 104 and sides 106 and 108 may have any suitable dimensions for wrapping, knotting, and fastening drip prevention device 100 around the neck of a bottle in the fashion illustrated in FIGS. 3A-3H. The dimensions of drip prevention device 100 may vary depending on the particular configuration of the bottle and/or the desired amount of material to be available for catching and absorbing drips. In one non-limiting example, strip 101 has a width of about 2 inches and a length of about 14½ inches.

As can be seen in FIG. 1A, fasteners 112, 114 are attached to a first side of strip 101 proximate to free ends 102 and 104. Alternatively, in some embodiments, one of fasteners 112, 114 may be placed on one side of strip 101 proximate to one of free ends 102 and 104, and the other of fasteners 112, 114 may be placed on the other side of strip 101 proximate to the other of free ends 102, 104. In use, once drip prevention device 100 has been knotted around bottle 300, fasteners 112, 114 are fastened together such that free ends 102, 104 of drip prevention device 100 are fastened together. Thus, drip prevention device 100 is not only knotted around bottle 300 but is also secured to bottle 300 via fasteners 112, 114. In one non-limiting example, fasteners 112, 114 take the form of hook-and-loop fasteners such as Velcro™. Other types of fasteners may alternatively be used as is suitable and appropriate. Fasteners 112, 114 may be attached to free ends 102, 104 by any suitable mechanism. In one non-limiting example, fasteners 112, 114 are sewn to free ends 102, 104. Fasteners 112, 114 may have any suitable dimensions and may be placed at any suitable location on strip 101. In one non-limiting example, fasteners 112, 114 have a width of about ½ inches and a length of about 1½ inches, and are centered between sides 106, 108 about 3/16 inches from free ends 102, 104.

As can be seen in FIGS. 1B, a decorative or ornamental piece 120 (such as a flower, bow tie, or any other suitable decorative or ornamental piece, for example) may be attached to a second side of strip 101, proximate one of free ends 102, 104 and on an opposite side of strip 101 relative to fasteners 112, 114. In the example of FIG. 1B, decorative piece 120 is attached to the second side of strip 101 (on an opposite side of strip 101 relative to fasteners 112, 114) proximate to free end 102. When fasteners 112, 114 are joined, they are covered or hidden by decorative piece 120, thereby enhancing the decorative or ornamental appearance of drip prevention device 100 when secured to bottle 300 (see FIG. 3H, for example). In addition, a brand tag or label 122 may be provided at any suitable location on drip prevention device 100.

In some examples, strip 101 may simply be formed or cut into suitable dimensions from a piece of flexible, absorbent material such as cotton, linen, or denim. In other examples, as illustrated in FIGS. 2A-2F, strip 101 is formed from a larger piece of flexible and absorbent material 200 that is suitably folded and sewn to provide strip 101 with greater structural integrity, improved appearance, and greater resistance to fraying and coming apart. In this regard, FIGS. 2A-2F are block diagrams showing steps in the construction of strip 101 of drip prevention device 100, including folding and sewing, in accordance with aspects of this disclosure.

Figure 2A:
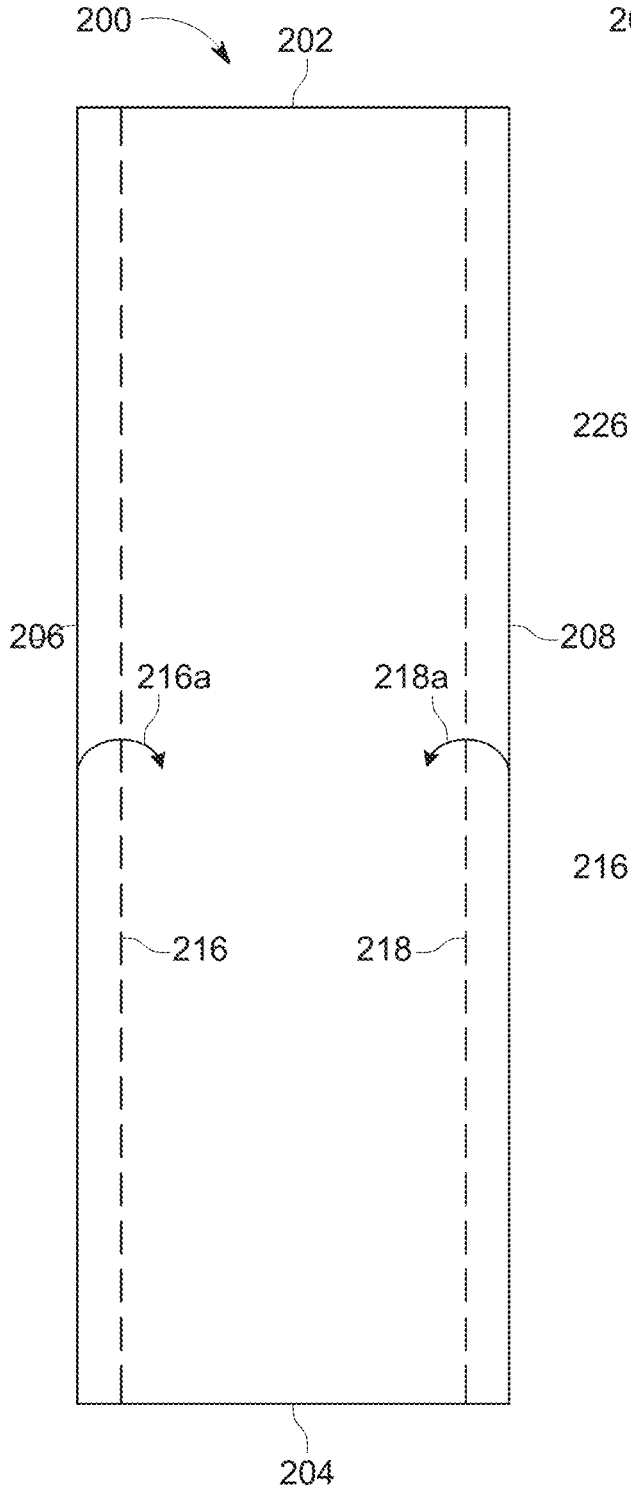
FIGS. 2A-2F are block diagrams showing steps in the construction of the drip prevention device of FIGS. 1A-1B, in accordance with aspects of this disclosure.

FIG. 2A illustrates a rectangular piece 200 of flexible and absorbent material such as cotton, linen, or denim from which drip prevention device 100 is formed. The piece of material 200 includes top and bottom edges 202, 204 and side edges 206, 208. In some examples, the piece of material 200 has greater dimensions than the final dimensions of strip 101 to accommodate the folding and sewing steps described below. In one non-limiting example, the piece of material 200 initially has a rectangular shape with a width of about 5 inches and a length of about 15 inches. Piece of material 200 may have any other suitable dimensions.

Figure 2B:
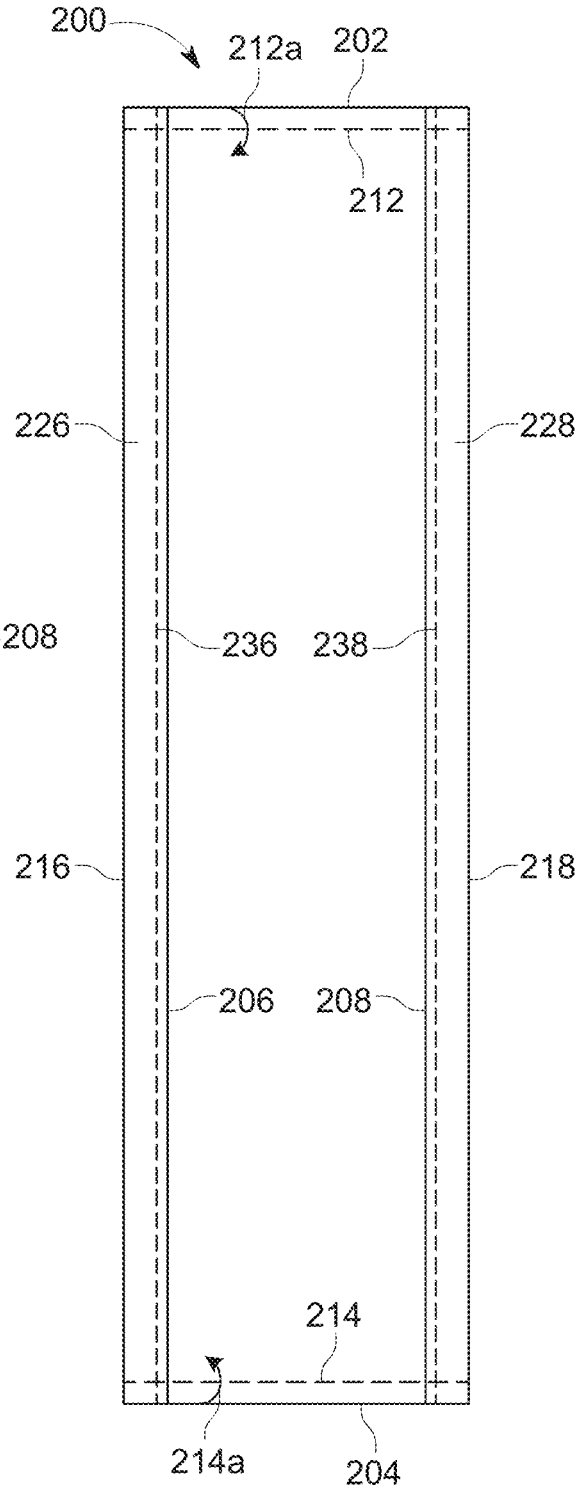

Side edges 206, 208 are folded over fold lines 216, 218 in the direction of arrows 216*a*, 218*a* (FIG. 2A) to form side hems 226, 228. FIG. 2B illustrates the piece of material 200 after formation of side hems 226, 228. Side hems 226, 228 are sewn down as indicated by stitch lines 236, 238, thereby securing edges 206, 208 and preventing edges 206, 208 from unraveling or coming apart. Side hems 226, 228 may have any suitable width. In one non-limiting example, side hems 226, 228 each have a width of about ½ inches, such that after formation of side hems 226, 228, the piece of material 200 has a remaining width of about 4 inches.

Figure 2C:
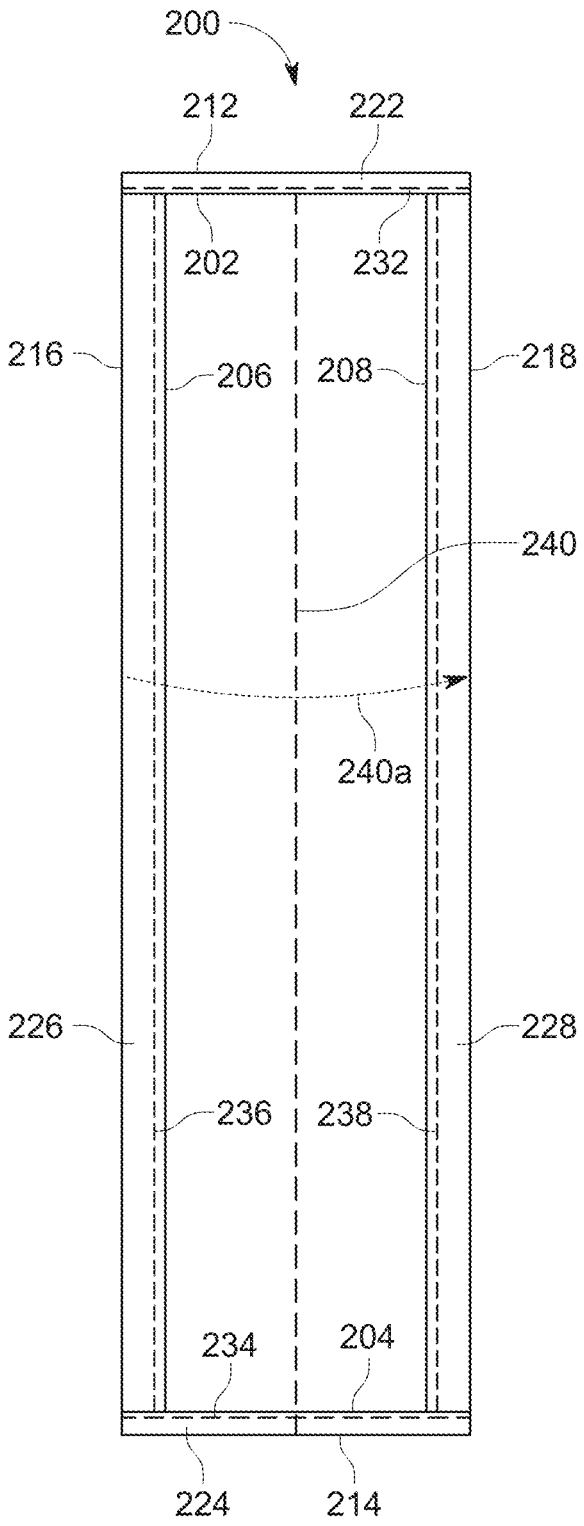

Next, top and bottom edges 202, 204 are folded over fold lines 212, 214 in the direction of arrows 212*a*, 214*a* (FIG. 2B) to form top and bottom hems 222, 224. FIG. 2C illustrates the piece of material 200 after formation of top and bottom hems 222, 224. Top and bottom hems 222, 224 are sewn down as indicated by stitch lines 232, 234, thereby securing edges 202, 204 and preventing edges 202, 204 from unraveling or coming apart. Top and bottom hems 222, 224 may have any suitable width. In one non-limiting example, top and bottom hems 222, 224 each have a width of about ¼ inches, such that after formation of top and bottom hems 222, 224, the piece of material 200 has a remaining length of about 14.5 inches.

Figure 2D:
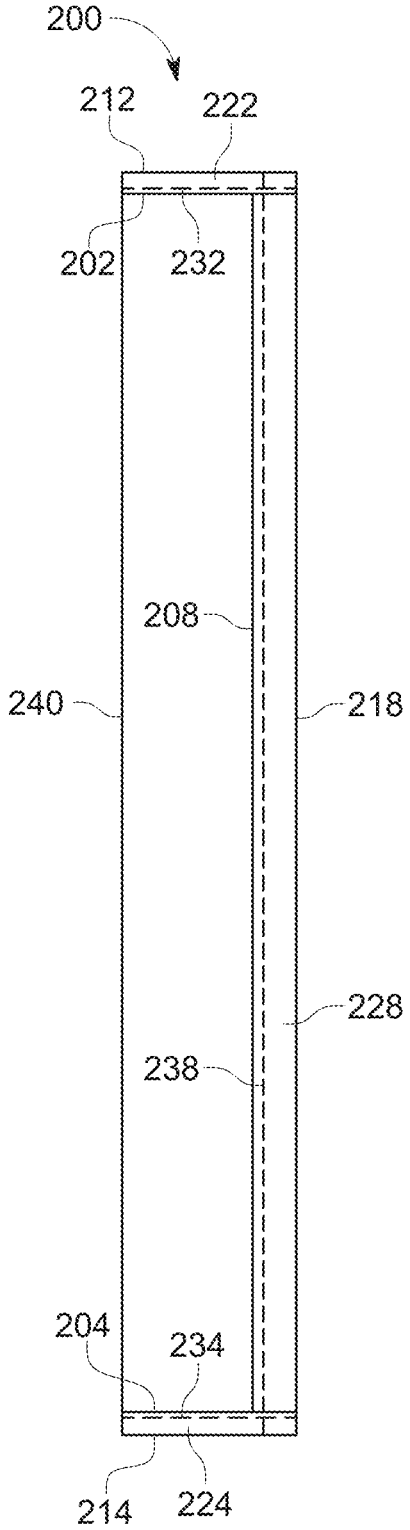

Next, the hemmed piece of material 200 is folded in half lengthwise about fold line 240 in the direction of arrow 240*a* (FIG. 2C). In this regard, side hem 226 is folded underneath fold line 240 (in a direction into the drawing sheet of FIG. 2C as indicated by dotted arrow 240*a*, that is, in the manner of a "mountain fold") such that after folding is complete, side hems 226 and 228 are vertically aligned with each other. That is, side hem 226 is positioned underneath side hem 228. FIG. 2D illustrates the piece of material 200 after it has been folded in half about line 240. Side hem 228 (visible in FIG. 2D) and side hem 226 (not visible in FIG. 2D, since it is positioned underneath side hem 228) are sewn together, such that the piece of material 200 in its state as shown in FIG. 2D has half the width and double the thickness relative to the strip of material 200 in its state as shown in FIG. 2C. Side hems 226 and 228 are then sewn together. In one non-limiting example, side hems 226 and 228 are sewn together along the existing stitch line 238 so as not to form another stitch line. In one non-limiting example, the piece of material 200 of FIG. 2D, after the folding operation, has a remaining width of about 2 inches (half that of the piece of material 200 in its state of FIG. 2C).

Figure 2E:
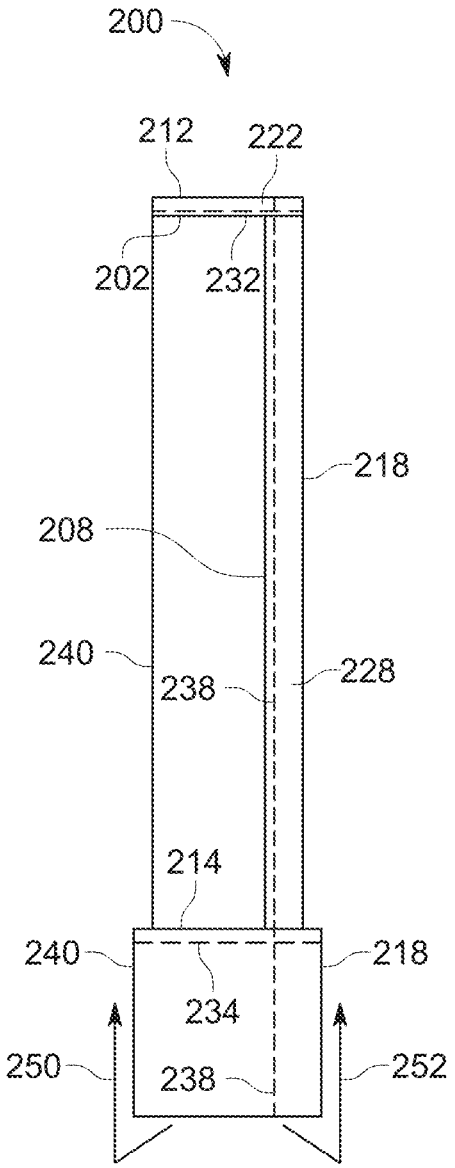
Figure 2F:
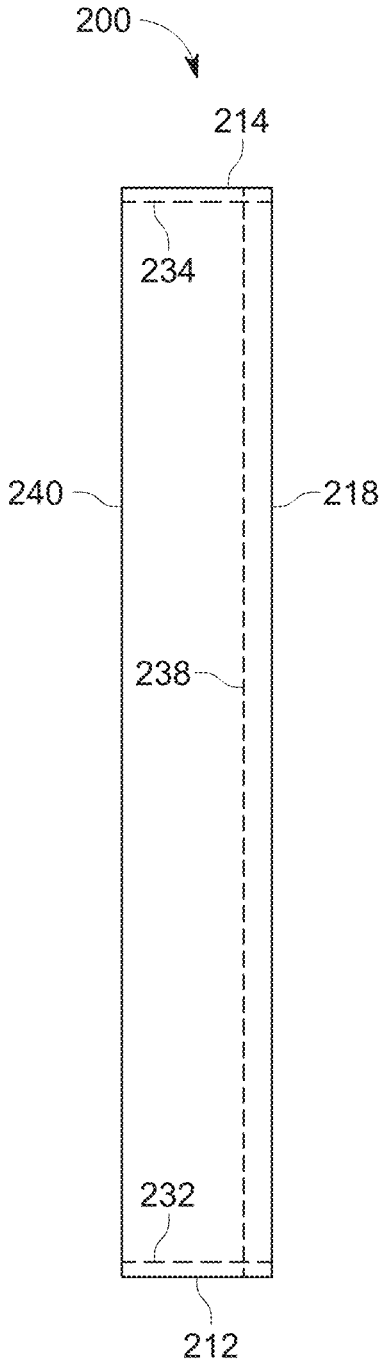

Top hem 222 is doubled over itself as a result of the folding operation, as is bottom hem 224. However, the doubled over portions of top hem 222 and bottom hem 224 are not initially sewn together, such that top end 212 and bottom end 214 of the piece of material 200 remain open-ended. As illustrated in FIG. 2E, this allows the piece of material 200 to be pulled through itself in the direction of arrows 250, 252, thereby being turned inside-out. As shown in FIG. 2F, once the piece of material 200 has been turned completely inside-out, all hems 222, 224, 226, 228 are now on the interior of the piece of material 200 and are obscured from the outside. Only the "clean" stitch lines 232, 234, 238 are visible, thereby providing an aesthetically pleasing and clean appearance. By forming the stitch lines from a thread having the same or a similar color as the piece of material 200, the stitch lines may also be partially or completely obscured. Once the piece of material 200 has been turned completely inside-out as shown in FIG. 2F, its open ends may optionally be sewn shut. In one non-limiting example, stitch lines are formed along the existing stitch lines 232, 234 to close the ends of the piece of material 200.

By performing the construction steps of FIGS. 2A-2F on the piece of material 200, it takes on the form of strip 101 from which drip prevention device 100 is formed (FIGS. 1A-1B). Construction of drip prevention device 100 is completed by attaching fasteners 112, 114 on a first side of strip 101 and the optional decorative piece 120 and branding label 122 on a second side of strip 101, as described with reference to FIGS. 1A-1B. While forming strip 101 per the construction steps of FIGS. 2A-2F advantageously provides drip prevention device 100 with greater structural integrity and resistance to unwanted fraying, folding, creasing, etc., strip 101 could alternatively be formed by simply cutting a piece of material, fabric, or cloth to suitable dimensions without performing the sewing and folding operations of FIGS. 2A-2F.

Figure 3A:
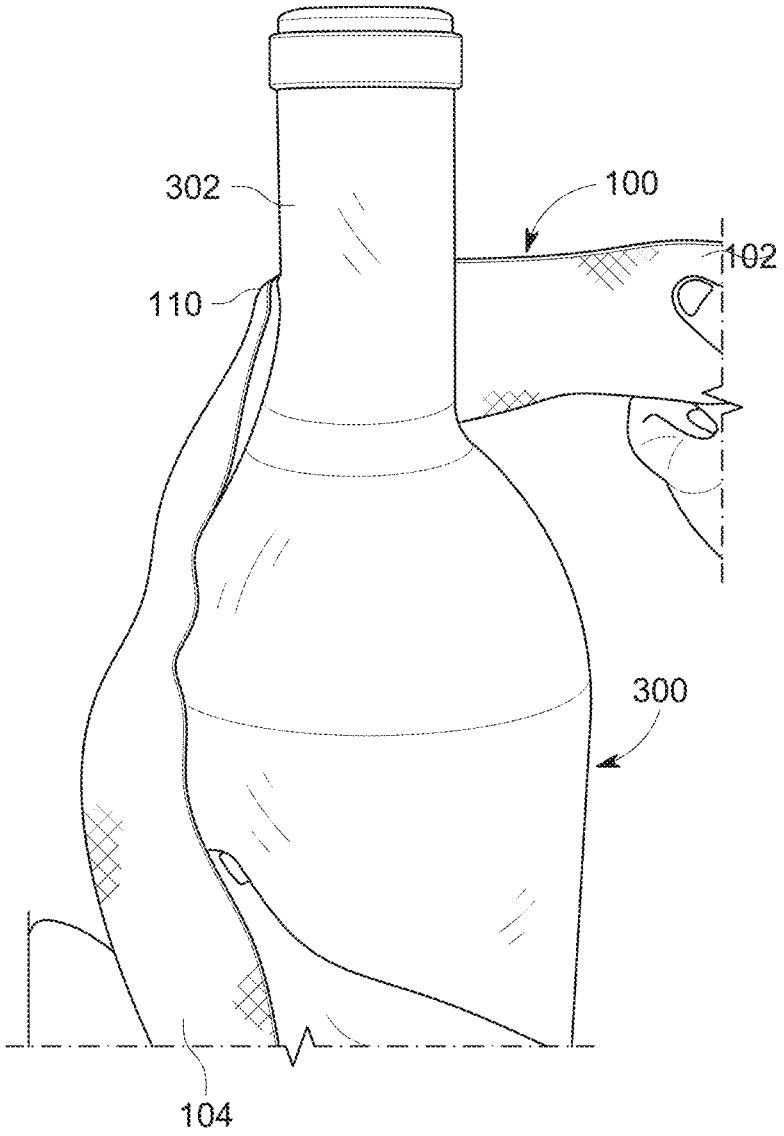
FIGS. 3A-3H are pictorial illustrations showing steps in wrapping, knotting, and fastening the drip prevention device of FIGS. 1A-1B around the neck of a bottle, in accordance with aspects of this disclosure.
Figure 3B:
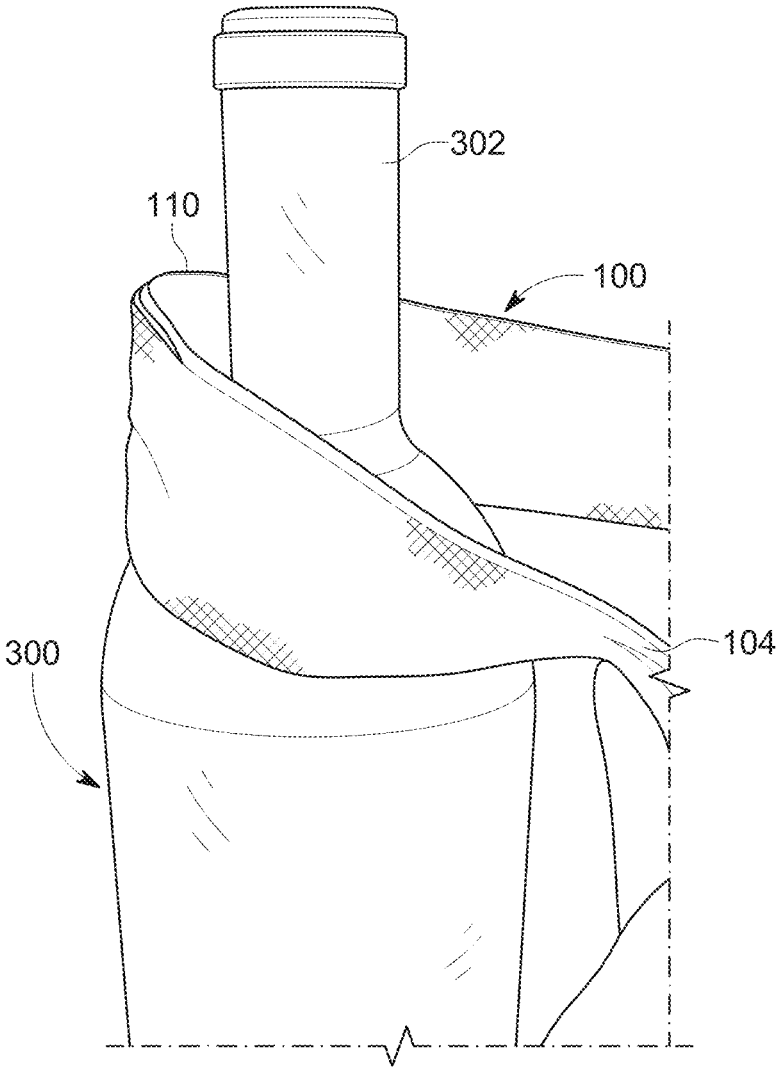
Figure 3C:
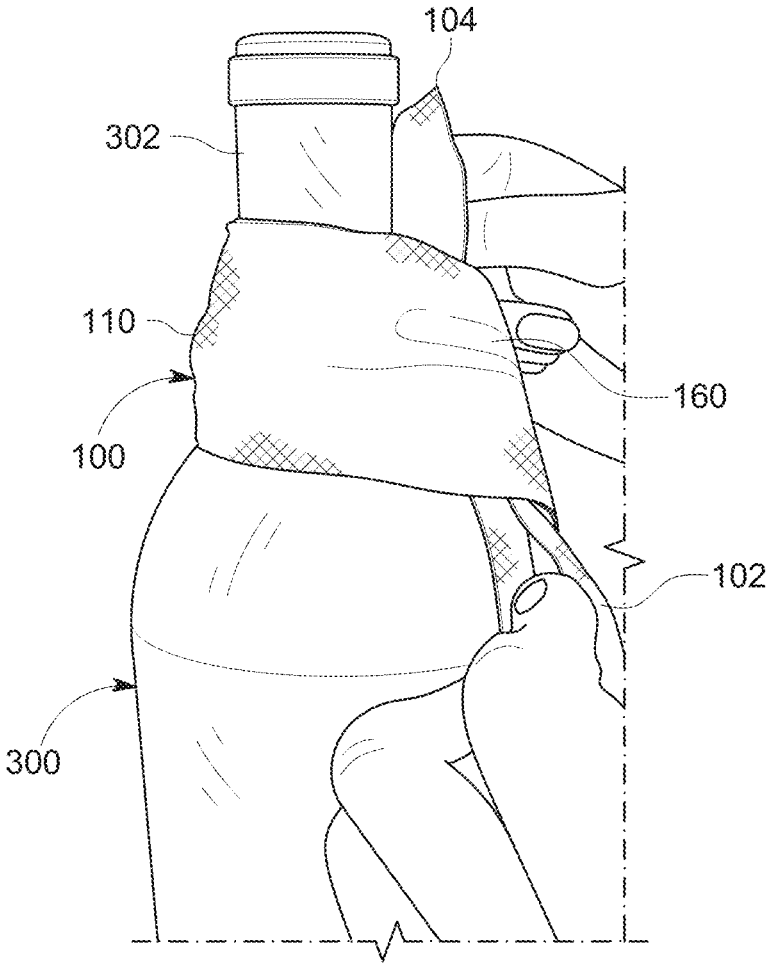
Figure 3D:
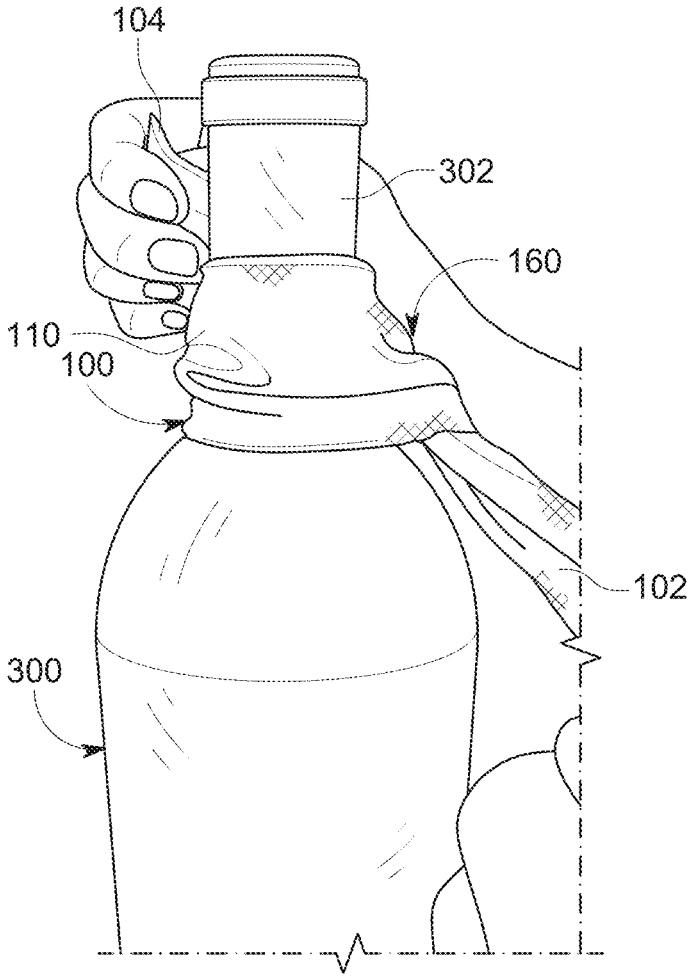
Figure 3E:
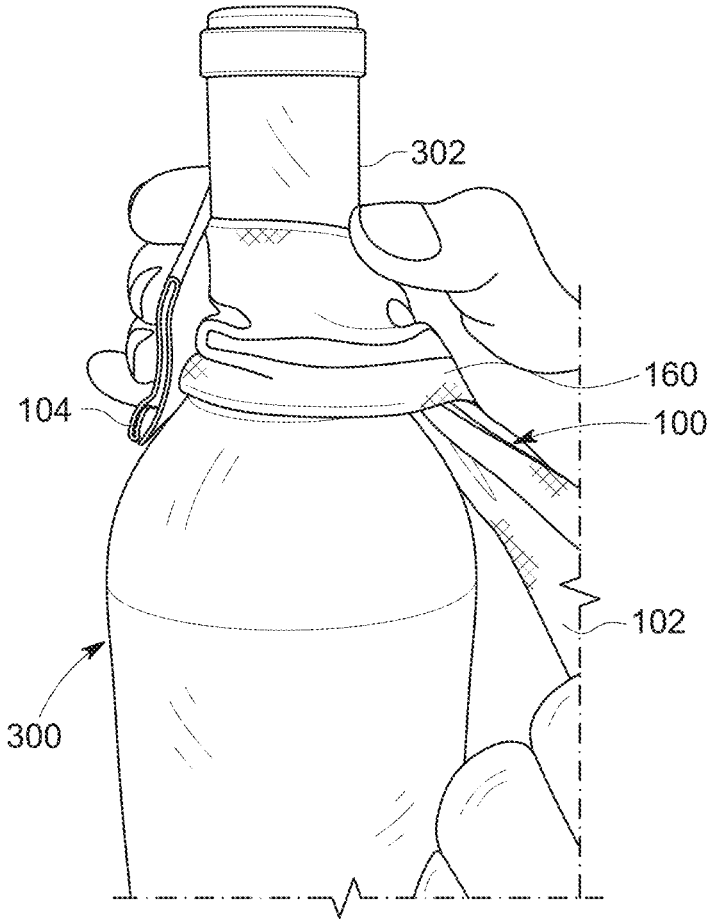
Figure 3F:
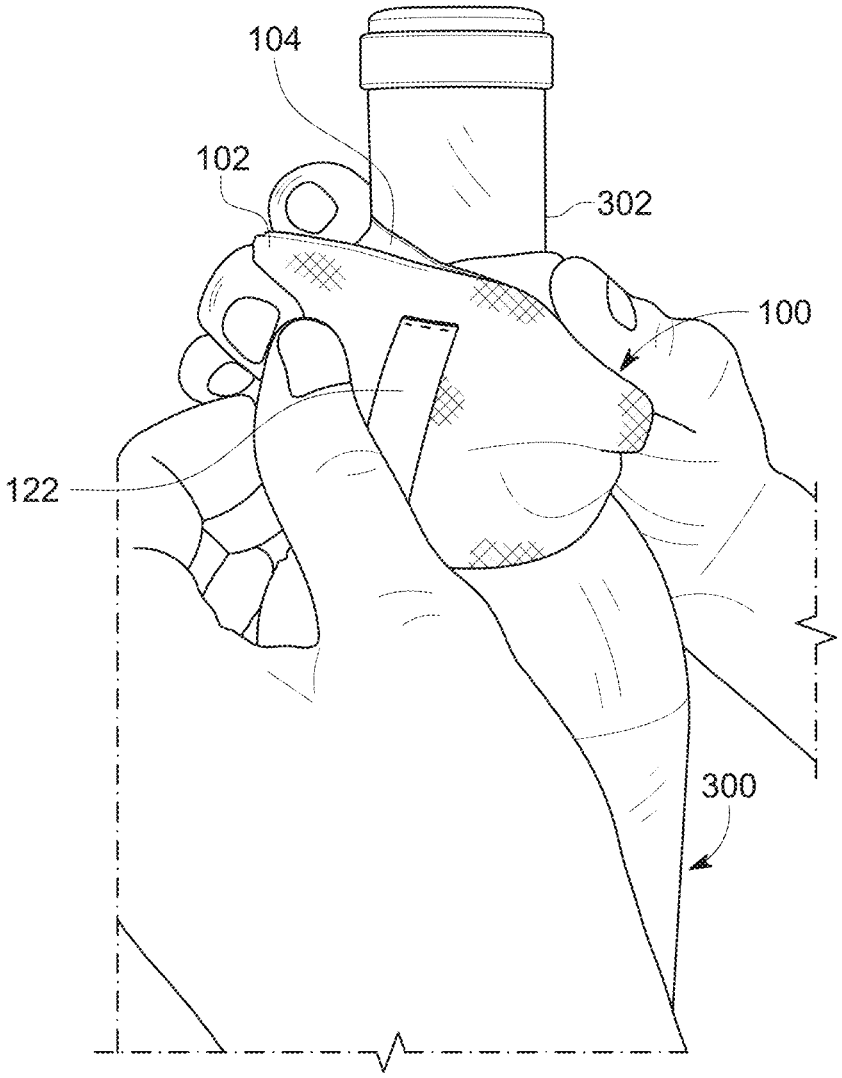
Figure 3G:
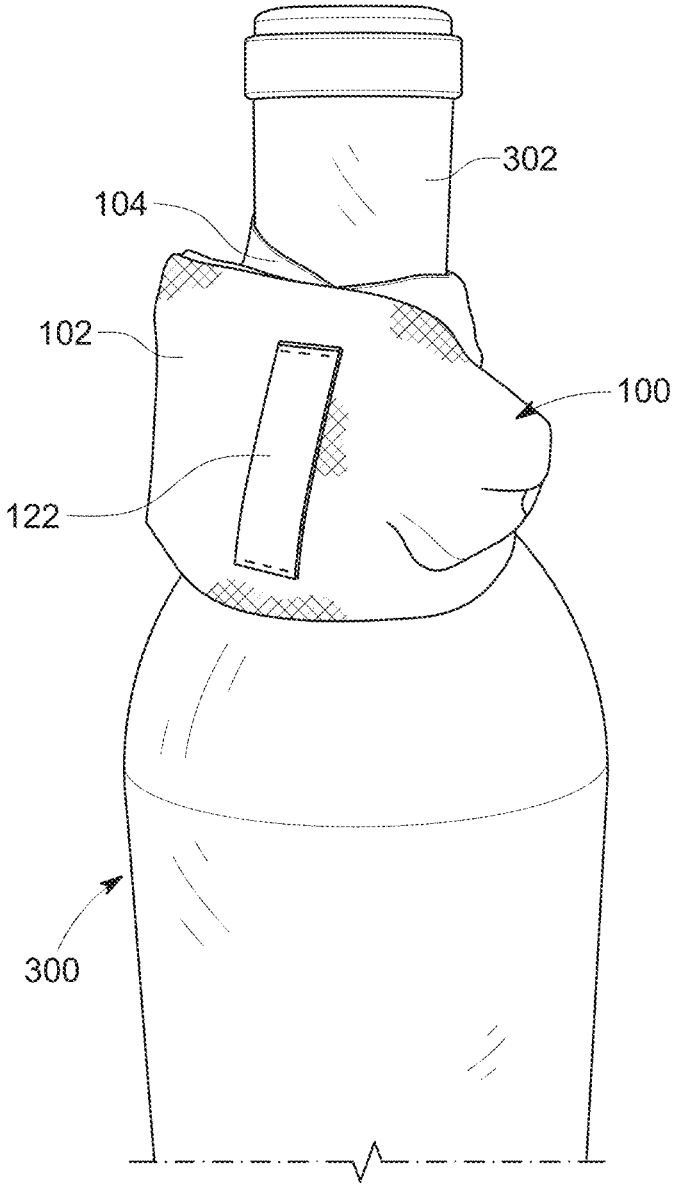
Figure 3H:
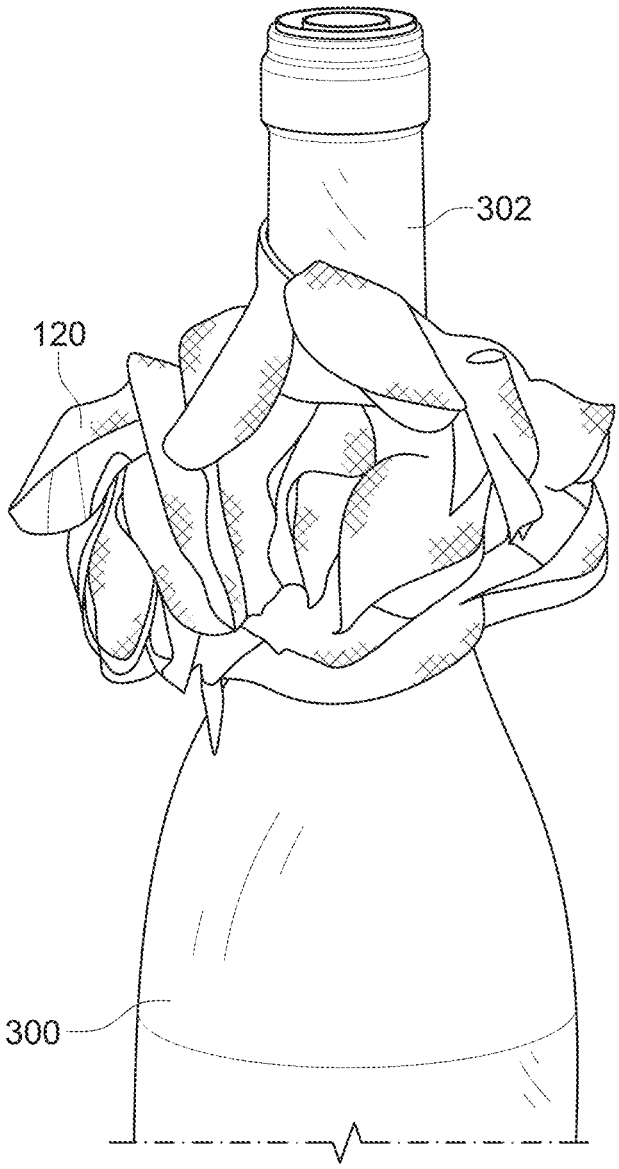

FIGS. 3A-3H illustrate the method by which drip prevention device 100 is secured to bottle 300, in accordance with aspects of this disclosure. FIGS. 3A-3D show wrapping and knotting of drip prevention device 100 around neck 302 of bottle 300. Drip prevention device 100 is first held with middle portion 110 positioned adjacent to neck 302 and free ends 102, 104 straddling bottle 300 (FIG. 3A). Decorative piece 122 may be attached to one of free ends 102, 104 as shown in FIG. 3H, but is not shown in FIGS. 3A-3G for sake of clear illustration. Drip prevention device 100 is then wrapped around neck 302, with free ends 102, 104 pulled such that middle portion 110 is pulled against or close to neck 302 (FIG. 3B). Drip prevention device 100 is then manipulated to form knot 160 around neck 302. In particular, free end 102 is crossed over free end 104 (or vice versa) and looped over, around, and under free end 104 (FIG. 3C). Free ends 102, 104 are then pulled apart from each other such that knot 160 is tightened around neck 302 (FIG. 3D).

FIGS. 3E-3G show fastening of fasteners 112, 114 to further secure drip prevention device 100 to bottle 300. In particular, free end 104 is pulled to the opposite side of neck 302 from where knot 160 is positioned with fastener 114 facing outward or away from neck 302 (FIG. 3E). Free end 102 is then moved over free end 104 with fastener 112 facing inward or towards fastener 114, such that fasteners 112, 114 can be fastened to each (FIG. 3F), thereby further securing drip prevention device 100 to bottle 300 and increasing the drip absorbing area of drip prevention device 100 that is in contact with bottle 300 (FIG. 3G). As can be seen in FIG. 3G, drip prevention device 100 is in contact with bottle 300 about its entire circumference, providing substantial surface area for the absorption of any drips that form as a consequence of pouring wine (or other liquid) from bottle 300.

FIG. 3H shows drip prevention device 100 secured to bottle 300 per the steps of FIGS. 3A-3G, with a decorative piece 120 attached to free end 102 on an opposite side to fastener 112 (i.e., in the vicinity of brand label 122 as shown in FIG. 3G). As can be seen, decorative piece 120 conceals some or all of drip prevention device 100 and is positioned on a side of neck 302 opposite knot 160. Bottle 300 can be positioned with decorative piece 120 in a pleasing and attractive orientation, with drip prevention device concealed underneath, and with knot 160 positioned on the opposite side of bottle 300 and out of view.

Figure 4:
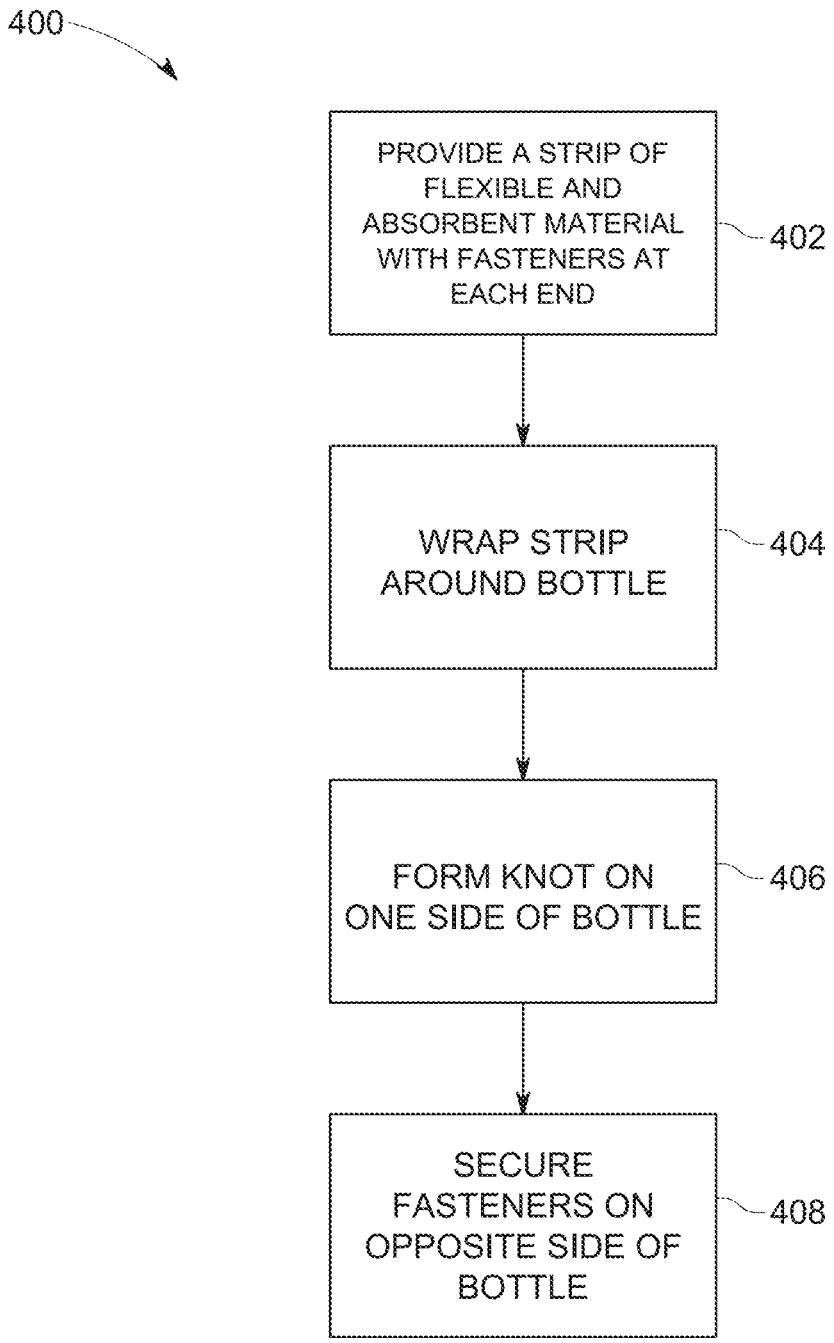
FIG. 4 is a flowchart of a method for preventing drips from a bottle, in accordance with aspects of this disclosure.

FIG. 4 is a flowchart of a method 400 for preventing drips from a bottle, in accordance with aspects of this disclosure. In step 402, as depicted in FIG. 1A, a strip 101 of flexible and absorbent material such as cotton, linen, or denim with a fastener 112, 114 at each end is provided. Strip 101 extends lengthwise between free ends 102 and 104 and widthwise between sides 106 and 108. In some examples, strip 101 is formed by folding and sewing as illustrated in FIGS. 2A-2F. Fasteners 112, 114 are attached to free ends 102, 104 and may take the form of hook-and-loop fasteners such as Velcro™.

In step 404, as illustrated in FIGS. 3A-3B, strip 101 is wrapped around bottle 300. In particular, strip 101 is positioned such that its middle portion 110 is behind neck 302 of bottle 300 with free ends 102, 104 straddling bottle 300. Free ends 102, 104 are then pulled such that middle portion 110 is pulled close to or against neck 302.

In step 406, as illustrated in FIGS. 3C-3D, knot 160 is formed on one side of bottle 300. In particular, free end 102 of strip 101 is crossed over free end 104 (or vice versa) and is then looped over, around, and under free end 104. Free ends 102, 104 are then pulled apart from each other such that knot 160 is formed and tightened around neck 302.

In step 408, as illustrated in FIGS. 3E-3G, fasteners 112, 114 are secured on the side of bottle 300 opposite to knot 160. In particular, free end 104 is pulled to the opposite side of neck 302 from where knot 160 is positioned, with fastener 114 facing outward or away from neck 302. Free end 102 is then moved over free end 104 with fastener 112 facing inward or towards neck 302, such that fasteners 112, 114 can be fastened to each other behind neck 302 to further secure drip prevention device 100 to bottle 300. Where a decorative piece 120 is attached to one of free ends 102, 104, the decorative piece 120 at least partially conceals drip prevention device 100 and is positioned on a side of neck 302 opposite knot 160 (FIG. 3H).

Certain terminology and derivations in this description may be used for non-limiting purposes of convenience. For example, terms such as "top," "bottom," "side," "left," "right," "middle," "adjacent," "opposite," "upward," "downward," "behind," etc. refer to directions in the drawings to which reference is made unless otherwise stated. Similarly, terms such as "inward" and "outward" refer to directions toward and away from, respectively, the geometric center of a device or area. Terms such as "attached to," "coupled to," "affixed to," "fastened to," "secured to," etc. may refer to a direct or indirect connection. References in the singular tense include the plural, and vice versa, unless otherwise noted. The term "comprises" and grammatical equivalents thereof means that other features, components, and steps are optionally present. For example, a device "comprising" components A, B, and C may contain only components A, B, and C or may contain components A, B, and C in addition to other components.

While certain embodiments are described herein, these embodiments are presented by way of example only, and do not limit the scope of this disclosure. Various omissions, substitutions and changes may be made without departing from the spirit and scope of this disclosure. The methods and processes described herein are not limited to any particular sequence and may be used independently or combined in various ways. Some method or process steps may be omitted and other steps added in some implementations. Nothing in this description implies that any particular feature, component, characteristic, or step is necessary or indispensable. Many variations, modifications, additions, and improvements are possible and fall within the scope of this disclosure as defined by the following claims.

The invention claimed is:

1. A drip prevention device comprising:

a strip of flexible and absorbent material extending from a first free end to a second free end;

a first fastener attached to the first free end; and a second fastener attached to the second free end, wherein the strip is configured with sufficient length to be wrapped around a bottle and knotted to form a knot on one side of the bottle with the first and second fasteners fastened on an opposite side of the bottle, thereby securing the drip prevention device to the bottle, the strip is formed from a piece of material having a rectangular shape, and the strip is formed by:

sewing side edges of the piece of material to form side hems;

sewing top and bottom edges of the piece of material to form top and bottom hems;

folding the piece of material in half lengthwise such that the side hems are aligned with each other;

sewing the side hems together; and pulling the piece of material lengthwise through itself such that the piece of material is turned inside-out and the top, bottom, and side hems are obscured.

2. The drip prevention device of claim 1, further comprising a decorative piece attached to one of the first and second free ends to at least partially conceal the drip prevention device when secured to the bottle.

3. The drip prevention device of claim 1, wherein the strip is configured with sufficient length to be wrapped around a neck of the bottle.

4. The drip prevention device of claim 1, wherein the flexible and absorbent material comprises cotton, linen, or denim.

5. The drip prevention device of claim 1, wherein the fasteners are hook-and-loop fasteners.

* * * * *